US009403207B2

(12) United States Patent
Chang et al.

(10) Patent No.: US 9,403,207 B2
(45) Date of Patent: Aug. 2, 2016

(54) SPIRAL BEVEL GEAR FORGING APPARATUS

(71) Applicant: Metal Industries Research and Development Centre, Kaohsiung (TW)

(72) Inventors: Can-Xun Chang, Kaohsiung (TW); Wan-Chi Chang, Kaohsiung (TW); Sheng-Chi Tsai, Kaohsiung (TW)

(73) Assignee: Metal Industries Research and Development Centre, Kaohsiung (TW)

( * ) Notice: Subject to any disclaimer, the term of this patent is extended or adjusted under 35 U.S.C. 154(b) by 115 days.

(21) Appl. No.: 14/552,983

(22) Filed: Nov. 25, 2014

(65) Prior Publication Data

US 2016/0144422 A1 May 26, 2016

(51) Int. Cl.
*B21K 1/30* (2006.01)
*B21D 45/02* (2006.01)
*B21D 45/06* (2006.01)

(52) U.S. Cl.
CPC . *B21K 1/30* (2013.01); *B21D 45/02* (2013.01); *B21D 45/06* (2013.01)

(58) Field of Classification Search
CPC ..... B21J 9/18; B21J 13/14; B21K 1/30; B21D 45/00; B21D 45/02; B21D 45/04; B21D 45/06; B21D 45/08; B21D 45/10; B21D 53/28
USPC ..... 29/893.34
See application file for complete search history.

(56) References Cited

U.S. PATENT DOCUMENTS 4,050,283 A * 9/1977 Schober ..... B21J 13/14 29/893.3
2005/0278952 A1* 12/2005 Ooka ..... B21K 1/30 29/893
2014/0007640 A1* 1/2014 Endo ..... B21C 23/183 72/352

* cited by examiner

*Primary Examiner* — Debra Sullivan
(74) *Attorney, Agent, or Firm* — LeClairRyan

(57) ABSTRACT

A spiral bevel gear forging apparatus for forging a blank includes a first mold core having a mold cavity for receiving the blank, a first punch rod inserted movably into the first mold core and having a positioning end extending into the mold cavity for releasable engagement with a bottom of the blank, at least one push mechanism, and a drive mechanism. When the drive mechanism is operated to move from a non-ejecting to an ejecting position, the push mechanism is actuated to drive the first mold core to rotate about the first punch rod, and the first punch rod is actuated to move relative to the first mold core such that the positioning end thereof is moved out of the mold cavity for ejecting the blank out of the first mold core.

9 Claims, 4 Drawing Sheets

SPIRAL BEVEL GEAR FORGING APPARATUS

FIELD OF THE INVENTION

The invention relates to a forging apparatus, more particularly to a forging apparatus for forging a blank into a spiral bevel gear.

BACKGROUND OF THE INVENTION

Conventional spiral bevel gears are formed by using a mechanical cutting process. However, such a processing method will waste a lot of material, and requires complicated processing and lengthy processing time, so that the efficiency thereof is low. Moreover, because metal fibers are cut off and are, thus, discontinuous during the cutting process, the structural strength of the finished product is rather weak. Manufacturers mostly use a forging method for pressing and molding. However, because a spiral bevel gear has spiral teeth with a negative draft angle, it cannot be directly stripped from the mold. A cutting tool must be additionally used, thereby resulting in the aforesaid drawbacks of the cutting process.

At present, there are two suggested methods of directly stripping from mold for forging. One method is to use a rotatable punch rod for pushing the processed and completed spiral bevel gear out of the mold. The rotatable punch rod rotates following tooth grooves inside the mold core. However, the punch rod of this method must be provided with a transmission component, such as a gear, and must coordinate with components, such as a motor, a rack bar, or a chain, so that this method is complicated and may destroy the strength of the punch rod. Another method is to rotate the mold core instead of the punch rod so that there is no need to process the punch rod which may destroy the strength thereof. In this method, the mold core is rotated, and the punch rod is used to push the spiral bevel gear out of the mold. Although this method can maintain the strength of the punch rod, the mold core must undergo the process of boring holes and grooves, thereby destroying the strength and the sealing effect of the mold core. Hence, there is still room for improvement.

SUMMARY OF THE INVENTION

Therefore, an object of this invention is to provide a spiral bevel gear forging apparatus that is capable of overcoming the aforesaid drawbacks of the prior art.

According to this invention, a spiral bevel gear forging apparatus for forging a blank comprises a first mold unit and a stripping unit. The first mold unit includes a first mold core having a mold cavity for receiving the blank, and a first punch rod inserted movably into the first mold core and having a positioning end extending into the mold cavity for releasable engagement with a bottom of the blank. The stripping unit includes at least one push mechanism capable of driving the first mold core to rotate about the first punch rod, and a drive mechanism operable to move between a non-ejecting position and an ejecting position. When the drive mechanism is operated to move from the non-ejecting position to the ejecting position, the push mechanism is actuated by the drive mechanism to drive the first mold core to rotate about the first punch rod, and the first punch rod is actuated by the drive mechanism to move relative to the first mold core such that the positioning end of the first punch rod is moved out of the mold cavity for ejecting the blank out of the first mold core.

BRIEF DESCRIPTION OF THE DRAWINGS

Other features and advantages of the invention will become apparent in the following detailed description of the embodiment with reference to the accompanying drawings, of which.

DETAILED DESCRIPTION OF THE EMBODIMENT

Referring to FIGS. 1 to 5, a spiral bevel gear forging apparatus 1 according to the embodiment of the present invention is installed in an upright manner for convenience of illustration, and is shown to comprise a first mold unit 2, a second mold unit 3, and a stripping unit 4.

Figure 2:
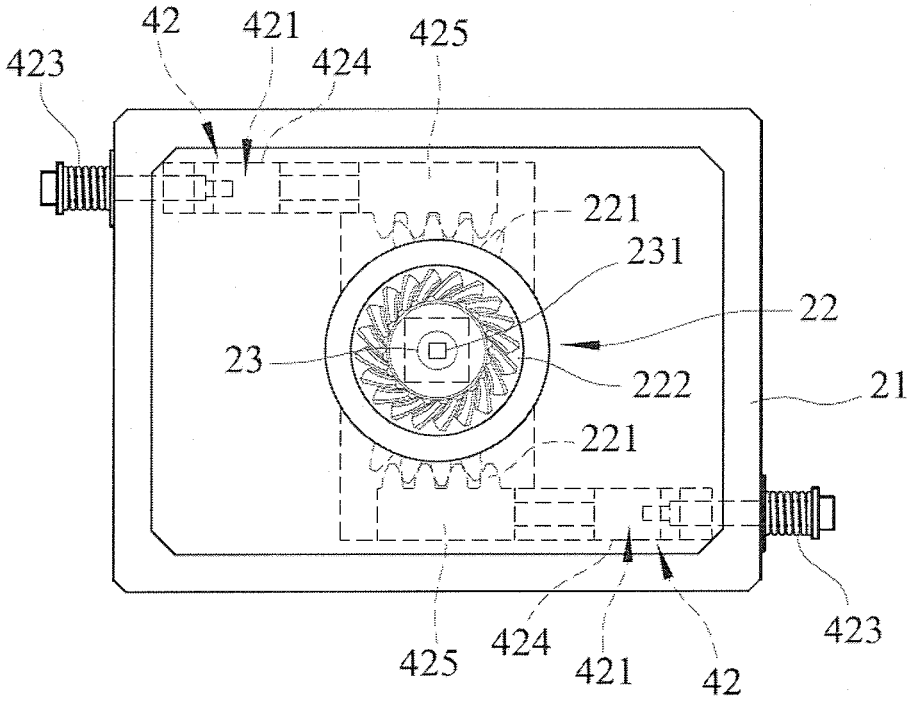
FIG. 2 is a schematic top view, illustrating relations between a first mold core and a push mechanism of the embodiment.

The first mold unit 2 includes a first mold seat 21, a first mold core 22 mounted in the first mold seat 21, a first punch rod 23 inserted movably into the first mold core 22, a first elastic member 24 sleeved on the first punch rod 23, and three rotary members 25 disposed between the first mold seat 21 and the first mold core 22 for reducing friction therebetween. The first mold core 22 has a mold cavity 222 for receiving a blank (B) to be forged, and includes two diametrically opposed tooth-shaped portions 221 projecting from an outer periphery of the first mold core 22, as shown in FIG. 2. The mold cavity 222 has a gear configuration and a negative draft angle. The first punch rod 23 has a positioning end 231 extending into the mold cavity 222 for releasable engagement with a bottom of the blank (B), and an enlarged end 232 opposite to the positioning end 231. In this embodiment, the positioning end 231 has a rectangular shape. Alternatively, the positioning end 231 may have an oval, triangular, rectangular, or any other shape. The first elastic member 24 has two opposite ends respectively abutting against the enlarged end 232 of the first punch rod 23 and the first mold core 22. Each of the rotary members 25 is a bearing.

The second mold unit 3 includes a second mold seat 31 matable with the first mold seat 21, a second mold core 32 disposed in the second mold seat 31 and matable with the first mold core 22, a second punch rod 33 disposed in the second mold seat 31 and extending into the second mold core 32, and a second elastic member 34 sleeved on the second punch rod 33 and having two opposite ends respectively abutting against the second mold seat 31 and the second mold core 32.

The stripping unit 4 includes a drive mechanism 41 and two push mechanisms 42. The drive mechanism 41 includes an ejector plate 411 disposed in the first mold seat 21 and connected to and supporting the first punch rod 23, an ejection lever 412 fixed to the ejector plate 411 and extending through the first mold seat 21 in a direction away from the first punch rod 23, and two restoring elastic members 413 each of which has two opposite ends respectively abutting against the first mold seat 21 and the ejector plate 411. The ejection lever 412 is connected to a power source (not shown), such as an air or oil cylinder, and is movable upward and downward relative to the first mold seat 21.

Figure 3:
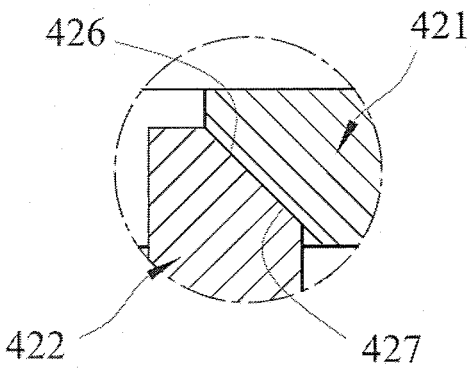
FIG. 3 is an enlarged sectional view of the encircled area (A) in FIG. 1.

Each of the push mechanisms 42 includes a first slide block 421, a second slide block 422, and a spring-loaded member 423. The first slide blocks 421 of the push mechanisms 42 are parallel to and spaced apart from each other, as best shown in FIG. 2. The first slide block 421 of each push mechanism 42 includes a body portion 424 having opposite inner and outer ends, a rack portion 425 disposed on the inner end of the body portion 424 and meshing with a respective one of the tooth-shaped portions 221 of the first mold core 22, and a first inclined surface 426 provided on the outer end of the body portion 424. The second slide block 422 of each push mechanism 42 has one end provided with a second inclined surface 427 slidably abutting against the first inclined surface 426, as best shown in FIG. 3, and another end opposite to the second inclined surface 427 and abutting against the ejector plate 411. FIG. 3 is an enlarged sectional view of the encircled area (A) in FIG. 1. The spring-loaded member 423 of each push mechanism 42 includes a headed shank 4231 extending through the first mold seat 21 and fixed to the first slide block 421, and a spring 4232 sleeved on the shank 4231 and having two opposite ends respectively abutting against the head of the shank 4231 and an outer side of the first mold seat 21.

Figure 1:
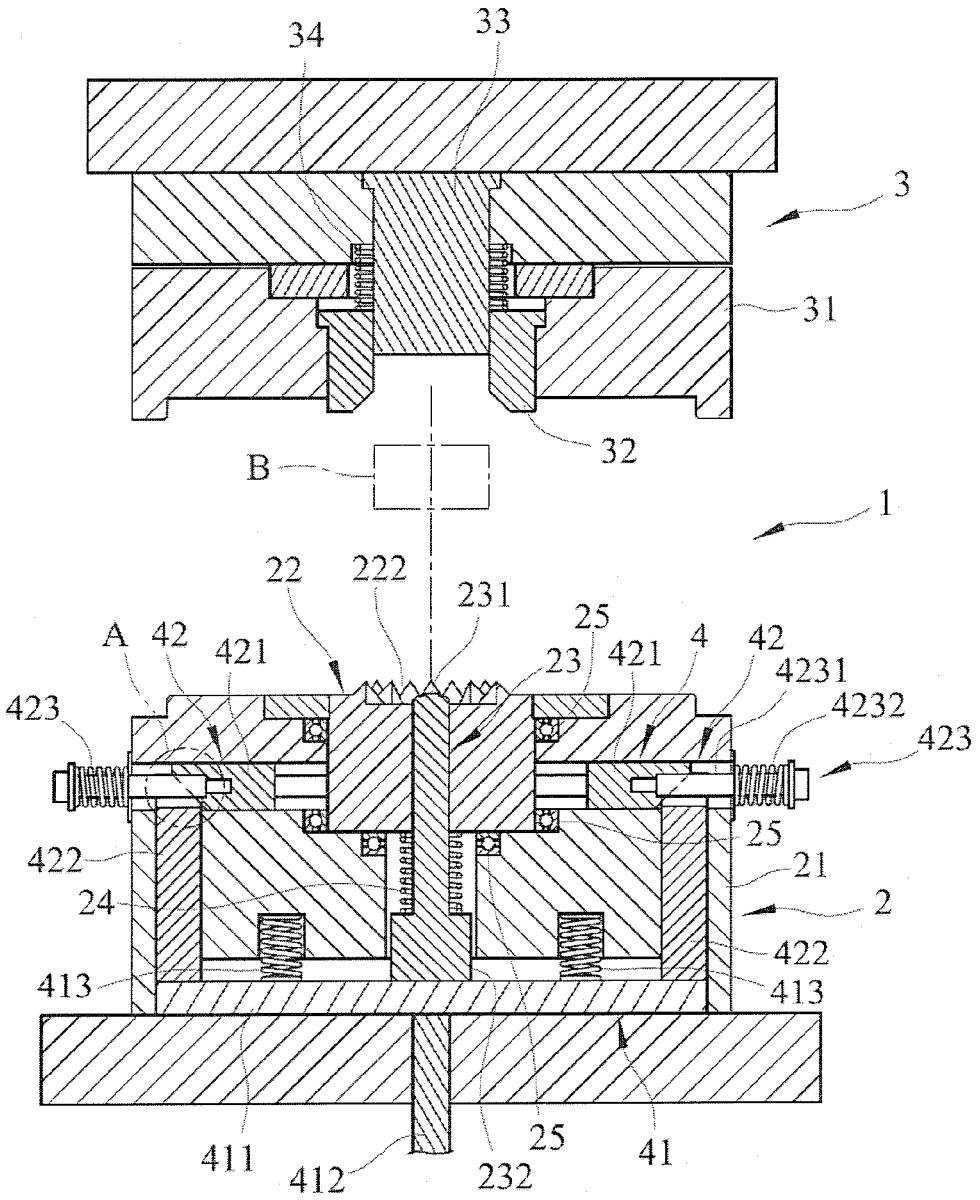
FIG. 1 is an exploded sectional view of a spiral bevel gear forging apparatus according to the embodiment of the present invention.
Figure 4:
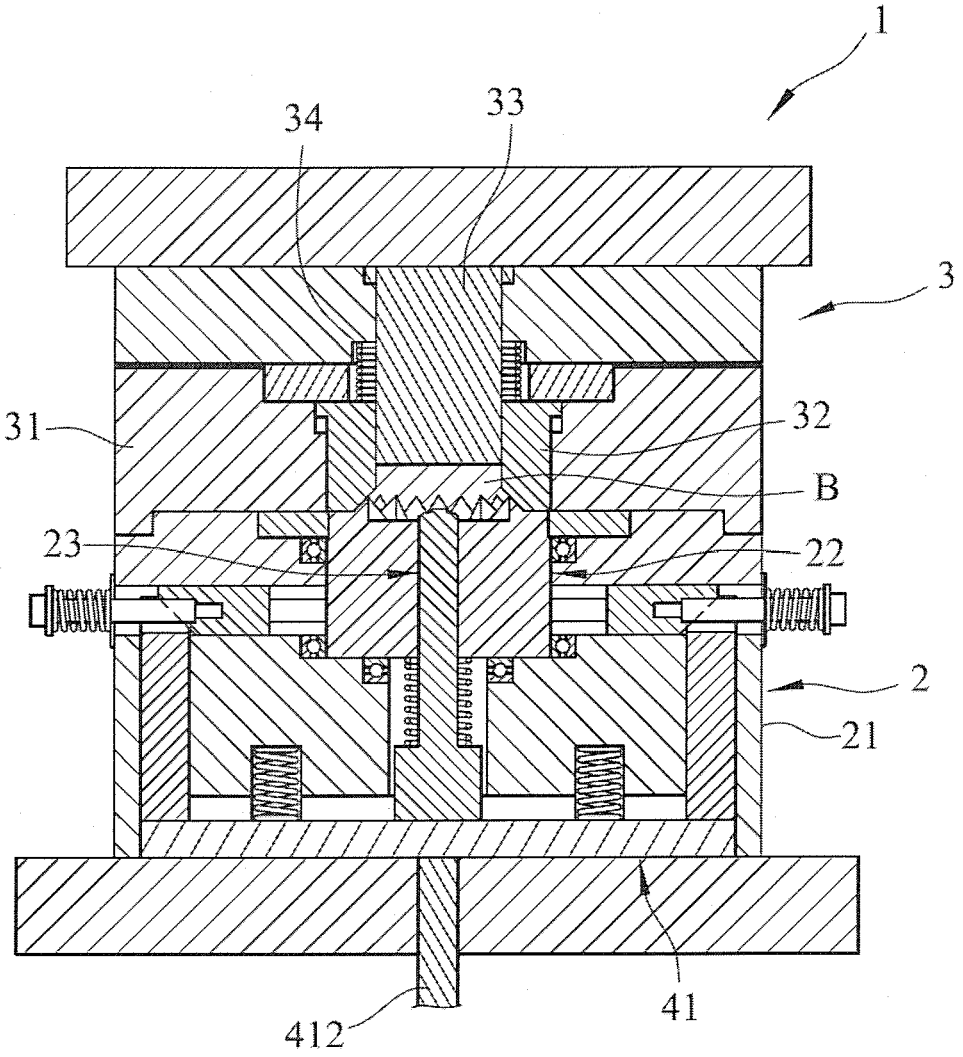
FIG. 4 is an assembled sectional view of the embodiment.

With reference to FIGS. 1 and 4, the operating steps of this invention are as follows: First, the blank (B) is placed in the mold cavity 222 of the first mold core 22, after which the second mold unit 3 is moved down to mate with the first mold unit 2. At this time, the first and second mold seats 21, 31 are mated, the first and second mold cores 22, 32 are also mated, and the first and second punch rods 23, 33 are respectively disposed on the bottom and top of the blank (B). Next, the second mold unit 3 is actuated to press downward, so that the second punch rod 33 presses downward against the blank (B) and cooperates with the first punch rod 23, which presses upward against the blank (B), to squeeze and deform the blank (B) until the blank (B) uniformly fills the gear-shaped mold cavity 222 of the first mold core 22, thereby forming a forged blank (B') which is a spiral bevel gear. During the downward pressing of the second mold unit 3, the second elastic member 34 is compressed by the second mold seat 31 to generate a biasing force that biases the second mold core 32 to tightly abut against the first mold core 22. As such, the first and second mold cores 31, 32 abut tightly against each other and are tightly closed during the forging process.

Figure 5:
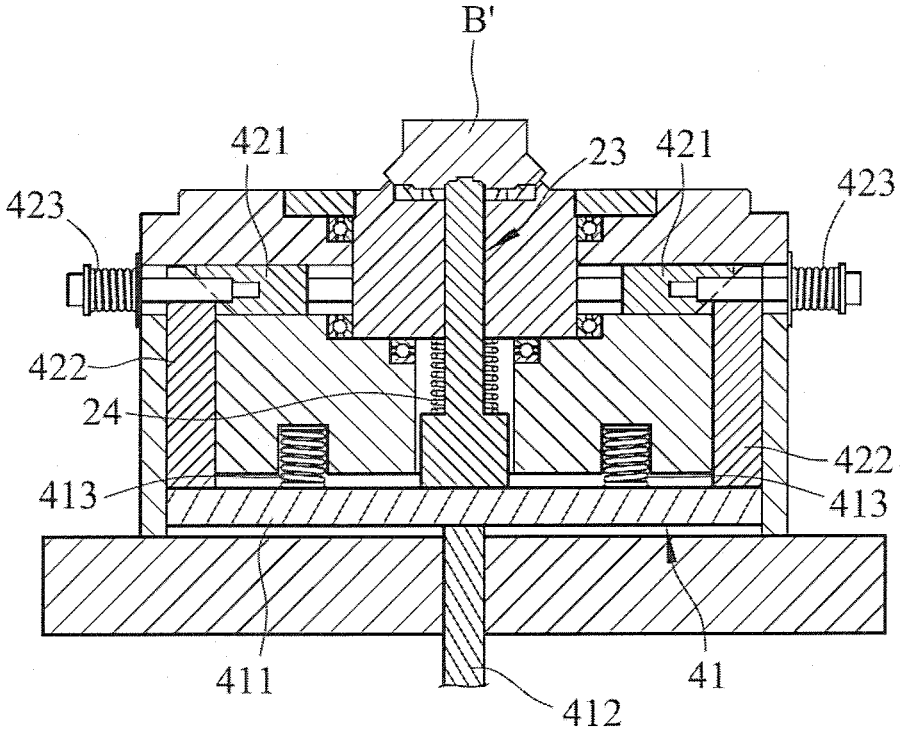
FIG. 5 is a sectional view of the embodiment, illustrating how a finished blank may be ejected from the mold.

With reference to FIGS. 2, 3 and 5, after the forging process is completed, the second mold unit 3 is moved upward to restore to its original position, and the power source (not shown) is activated to move the drive mechanism 41 from a non-ejecting position shown in FIG. 4 to an ejecting position shown in FIG. 5. During this movement, the ejection lever 412 of the drive mechanism 41 pushes upward the ejector plate 411, which in turn pushes upward the second slide blocks 422 and the first punch rod 23. Through this, the second inclined surfaces 427 of the second slide blocks 422 respectively push the first inclined surfaces 426 of the first slide blocks 421 to move the first slide blocks 421 toward each other. Because the rack portions 425 of the first slide blocks 421 are respectively meshed with the tooth-shaped portions 221 of the first mold core 22, as the first slide blocks 421 move toward each other, the first mold core 22 is pushed to rotate about the first punch rod 23. Because the positioning end 231 of the first punch rod 23 is engaged with the bottom of the forged blank (B'), and because of the shape of the positioning end 231, the forged blank (B') is prevented from rotation. In coordination with the rotation of the first mold core 22, the first punch rod 23 pushes the forged blank (B') out of the first mold core 22, thereby stripping the forged blank (B') from the first mold core 22. During movement of the drive mechanism 41 from the non-ejecting position to the ejecting position, the first elastic member 24, the restoring elastic members 413 and the spring-loaded members 423 are all compressed. After the stripping operation is completed, the first elastic member 24 restores the first punch rod 23 to its original position, the restoring elastic members 413 restore the ejector plate 411 to its original position, and the spring-loaded members 423 restore the first slide blocks 421 to their original positions. This positioning mechanism can prevent the first mold core 22 from being unable to rotate back to its original position during rotation, and can directly proceed with the next processing operation without the need for re-calibration. Hence, the processing accuracy is enhanced, and the processing time is saved.

This invention uses a mechanism that rotates for stripping, so that only a single operation is needed to produce a forged article having a complicated shape and a precise size. The issue of difficulty in stripping the forged blank having a negative draft angle from the mold can thus be resolved. Further, there is no need for additional cutting processes so that the material can be saved, the processing operation can be minimized, and the cost can be reduced. Moreover, during forging, the first and second mold cores 22, 32 are in a closed state, so that formation of burrs on the forged blank (B') can be greatly reduced. In addition, metal flow lines can be distributed along the contour of the forged blank (B'), thereby preventing the flow line edge of the forged blank (B') from being exposed. The mechanical properties of the forged blank (B') can thus be improved.

In sum, by using the linkage between the first slide blocks 421 and the second slide blocks 422, the first mold core 22 is rotatable about the first punch rod 23, and the forged blank (B') can be ejected out of the first mold core 22, thereby completing the stripping operation. The integrities of the first punch rod 23 and the first mold core 22 are not destroyed so that their strengths and precisions are enhanced, and the issue of stripping from the mold with difficulty is resolved. Therefore, the object of this invention is achieved.

While the invention has been described in connection with what is considered the most practical embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A spiral bevel gear forging apparatus for forging a blank, said spiral bevel gear forging apparatus comprising:

a first mold unit including a first mold core having a mold cavity for receiving the blank, and a first punch rod inserted movably into said first mold core and having a positioning end extending into said mold cavity for releasable engagement with a bottom of the blank; and a stripping unit including at least one push mechanism capable of driving said first mold core to rotate about said first punch rod, and a drive mechanism operable to move between a non-ejecting position and an ejecting position;

wherein, when said drive mechanism is operated to move from said non-ejecting position to said ejecting position, said push mechanism is actuated by said drive mechanism to drive said first mold core to rotate about said first punch rod, and said first punch rod is actuated by said drive mechanism to move relative to said first mold core such that said positioning end of said first punch rod is moved out of said mold cavity for ejecting the blank out of said first mold core.

2. The spiral bevel gear forging apparatus as claimed in claim 1, wherein said drive mechanism includes an ejector plate connected to and supporting said first punch rod, and said push mechanism includes a first slide block capable of pushing said first mold core to rotate, and a second slide block disposed on said ejector plate and abutting against said first slide block.

3. The spiral bevel gear forging apparatus as claimed in claim 2, wherein said first slide block includes a body portion having opposite inner and outer ends, and a first inclined surface provided on said outer end of said body portion, said second slide block having a second inclined surface slidably abutting against said first inclined surface.

4. The spiral bevel gear forging apparatus as claimed in claim 3, wherein said first mold core includes at least one tooth-shaped portion projecting outward from an outer periphery of said first mold core, and said first slide block further includes a rack portion disposed on said inner end of said body portion and meshing with said at least one tooth-shaped portion.

5. The spiral bevel gear forging apparatus as claimed in claim 2, wherein said first mold unit further includes a first mold seat for mounting of said first mold core, and a first elastic member sleeved on said first punch rod, said first punch rod further having an enlarged end opposite to said positioning end, said first elastic member having two opposite ends respectively abutting against said enlarged end of said first punch rod and said first mold core.

6. The spiral bevel gear forging apparatus as claimed in claim 5, further comprising a second mold unit which includes a second mold seat matable with said first mold seat, a second mold core disposed in said second mold seat and matable with said first mold core, a second punch rod disposed in said second mold seat and extending into said second mold core, and a second elastic member sleeved on said second punch rod and having two opposite ends respectively abutting against said second mold seat and said second mold core.

7. The spiral bevel gear forging apparatus as claimed in claim 6, wherein said first slide block is disposed in said first mold seat, and said push mechanism further includes a spring-loaded member connected to said first slide block.

8. The spiral bevel gear forging apparatus as claimed in claim 2, wherein said drive mechanism further includes at least one restoring elastic member having two opposite ends respectively abutting against said ejector place and said first mold seat.

9. The spiral bevel gear forging apparatus as claimed in claim 5, wherein said first mold unit further includes at least one rotary member disposed between said first mold seat and said first mold core for reducing friction therebetween, said drive mechanism further including an ejection lever disposed on said ejector plate and extending through said first mold seat in a direction away from said first punch rod.

* * * * *